US006327992B1

(12) United States Patent
Martin

(10) Patent No.: US 6,327,992 B1
(45) Date of Patent: Dec. 11, 2001

(54) HYDRAULIC LIFT FOR SMALL WATERCRAFT MOUNTED TO A BOAT TRANSOM

(75) Inventor: Richard A. Martin, St. Petersburg, FL (US)

(73) Assignee: General Hydraulic Solutions, Inc., Clearwater, FL (US)

( * ) Notice: Subject to any disclaimer, the term of this patent is extended or adjusted under 35 U.S.C. 154(b) by 0 days.

(21) Appl. No.: 09/775,277

(22) Filed: Feb. 1, 2001

(51) Int. Cl.[7] ..... B63B 35/40
(52) U.S. Cl. ..... 114/259; 114/369
(58) Field of Search ..... 114/258, 259, 114/369, 368, 373, 44, 48

(56) References Cited

U.S. PATENT DOCUMENTS

| | | | | |
|---|---|---|---|---|
| 4,027,492 | | 6/1977 | Carpenter . | |
| 4,149,469 | | 4/1979 | Bigler . | |
| 4,895,479 | | 1/1990 | Michaelsen et al. . | |
| 5,140,923 | * | 8/1992 | Wood | 114/48 |
| 5,170,742 | | 12/1992 | Roskelley . | |
| 5,184,914 | | 2/1993 | Basta . | |
| 5,193,479 | | 3/1993 | Bielefeld . | |
| 5,275,505 | | 1/1994 | Wilcox . | |
| 5,544,606 | * | 8/1996 | Schmidt, Jr. | 114/48 |
| 5,562,362 | | 10/1996 | Vezner . | |
| 5,687,663 | | 11/1997 | Wahlstrand . | |
| 5,690,045 | * | 11/1997 | Gauthier | 114/259 |
| 5,890,835 | | 4/1999 | Basta et al. . | |
| 5,919,000 | | 7/1999 | Unkle . | |

* cited by examiner

*Primary Examiner*—Ed Swinehart
(74) *Attorney, Agent, or Firm*—Larson & Larson, P.A.; James E. Larson

(57) ABSTRACT

A transom bracket enclosing a hydraulic power cylinder is mounted to the transom of a watercraft. An actuation rod of the power cylinder moves multiple lift arms connected to a platform bracket supporting a platform for supporting a small auxiliary watercraft. Electrical or manual operation of the power cylinder causes the platform bracket to move in a vertical direction either upwards out of the water or downwards into the water. A lock mechanism operated by a lock cylinder locks the lift apparatus in place when not in operation. Grooves on sides of the transom bracket and transversely extended pins connecting the linkage arms provide a downward stop to movement of the lift apparatus.

6 Claims, 9 Drawing Sheets

HYDRAULIC LIFT FOR SMALL WATERCRAFT MOUNTED TO A BOAT TRANSOM

FIELD OF THE INVENTION

This invention relates to hydraulic boat lifts. More particularly, it refers to a hydraulic lift mounted on the transom of a watercraft for lifting small auxiliary watercraft from the water, including support means for preventing damage caused by following seas.

DESCRIPTION OF THE INVENTION

Hydraulic operated boat lifts generally are well known as shown in U.S. Pat. Nos. 4,895,479; 5,184,914; 5,275,505; 5,890,835; and 5,919,000. None of these lift systems is adapted for mounting on the transom of a watercraft. Applicant has previously developed a vessel transom mounted hydraulic lift system for supporting a platform used to cradle an auxiliary watercraft. However, this system had a limitation which prevented practical utilization. During heavy following seas, the impact of water on the platform caused the hydraulic lift system arms to collapse. A hydraulic lift system is needed which will be practical for long term use mounted on the transom of a watercraft for the purpose of lifting small auxiliary watercraft out of the water and withstanding the impact of large waves during following seas.

SUMARRY OF THE INVENTION

This invention satisfies the need for an efficient and practical hydraulic lift system attached to a transom of a watercraft for lifting small auxiliary watercraft out of the water and withstanding wave action caused by following seas. The hydraulic lifting apparatus includes a transom bracket bolted to a transom of a watercraft, the transom bracket enclosing an hydraulic power cylinder operating multiple link arms causing a platform bracket to move in a vertical direction upwards from the water or down into the water. The platform bracket supports a platform and a boat cradle for supporting a small auxiliary watercraft. A locking plate operated by a hydraulic cylinder and grooves for receipt of a transverse pin lock the platform in an upright position and stops to prevent distortion of the action arms create a stable platform resistant to wave action.

The hydraulic power cylinder is either operated electrically or by a manual override connected to a hand pump.

BRIEF DESCRIPTION OF THE DRAWINGS

The invention may be best understood by those having ordinary skill in the boat lift art by reference to the following detailed description when considered in conjunction with the accompanying drawings in which.

DETAILED DESCRIPTION OF THE INVENTION

Figure 1:
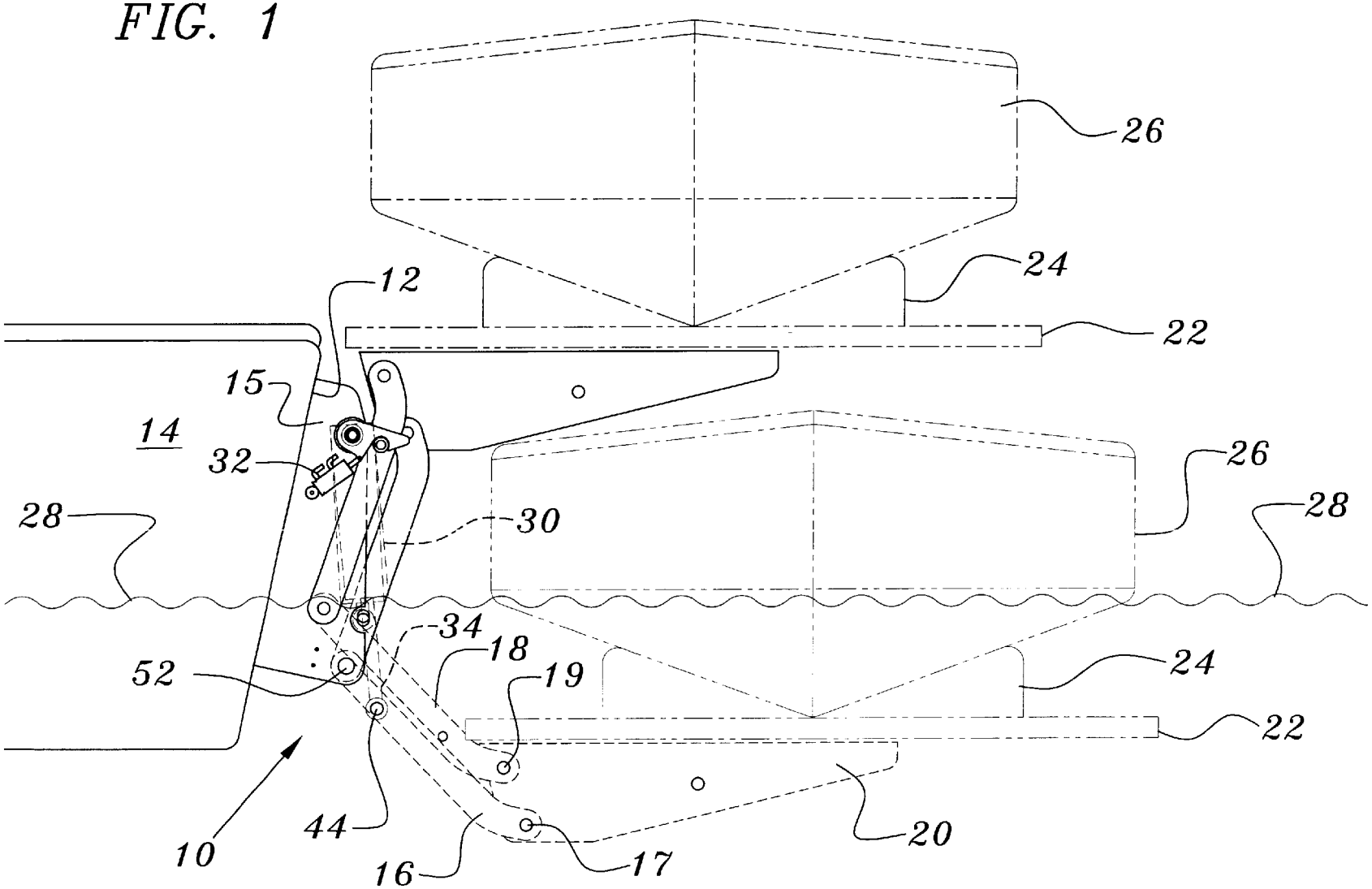
FIG. 1 is an elevational side view of the boat lift apparatus of this invention mounted to a boat transom and showing an auxiliary watercraft in phantom being lifted from the water.
Figure 2:
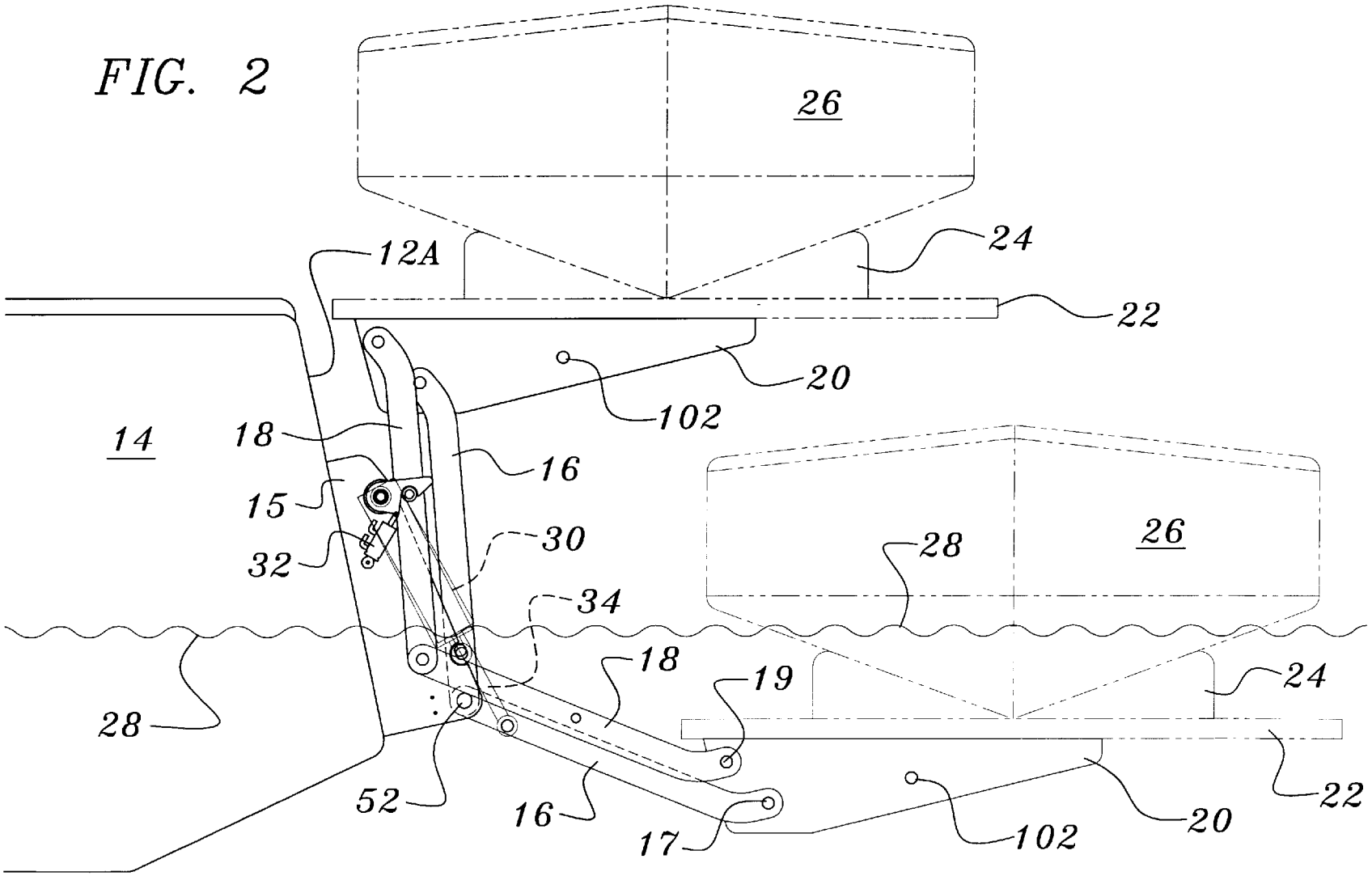
FIG. 2 is an elevational side view of the boat lift apparatus according to FIG. 1, but with the boat lift apparatus mounted to a differently configured boat transom.
Figure 3:
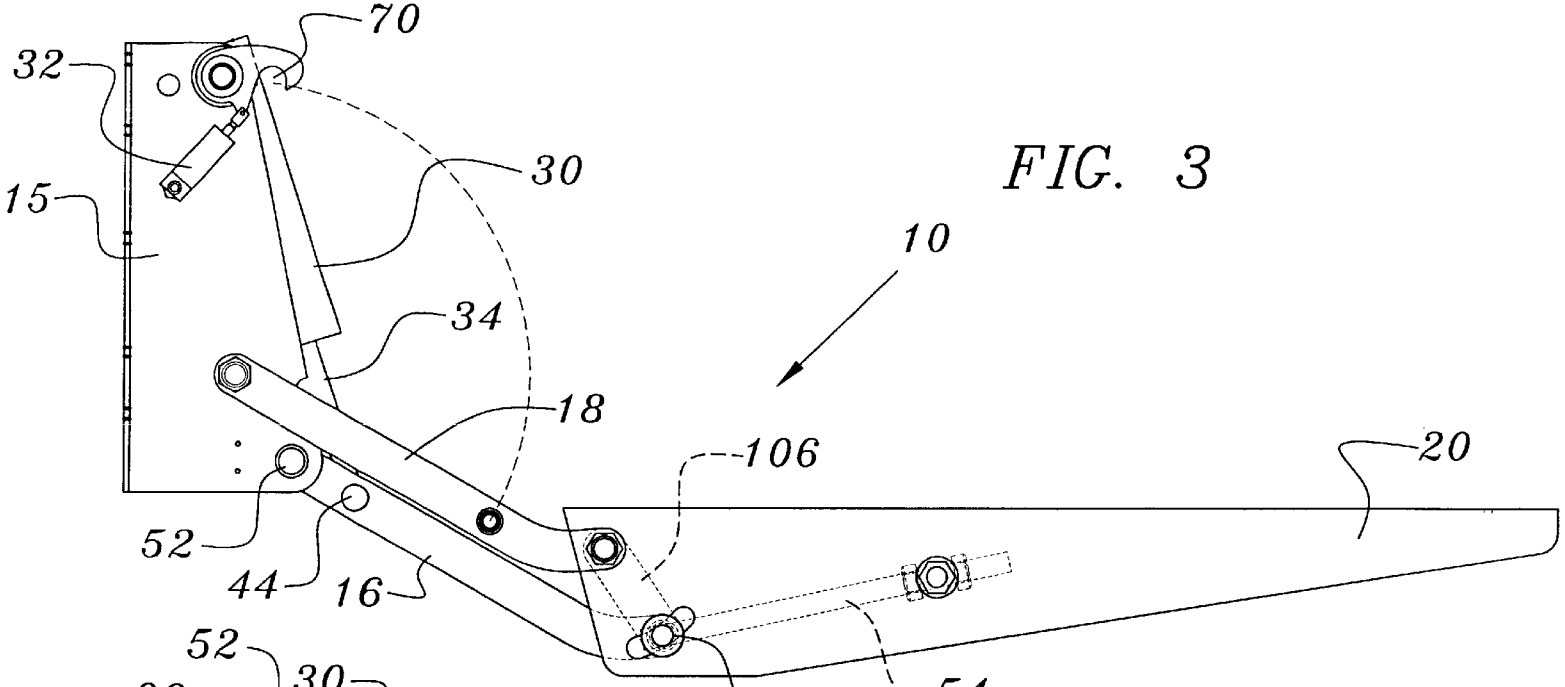
FIG. 3 is an isolated elevational side view of the boat lift apparatus.
Figure 4:
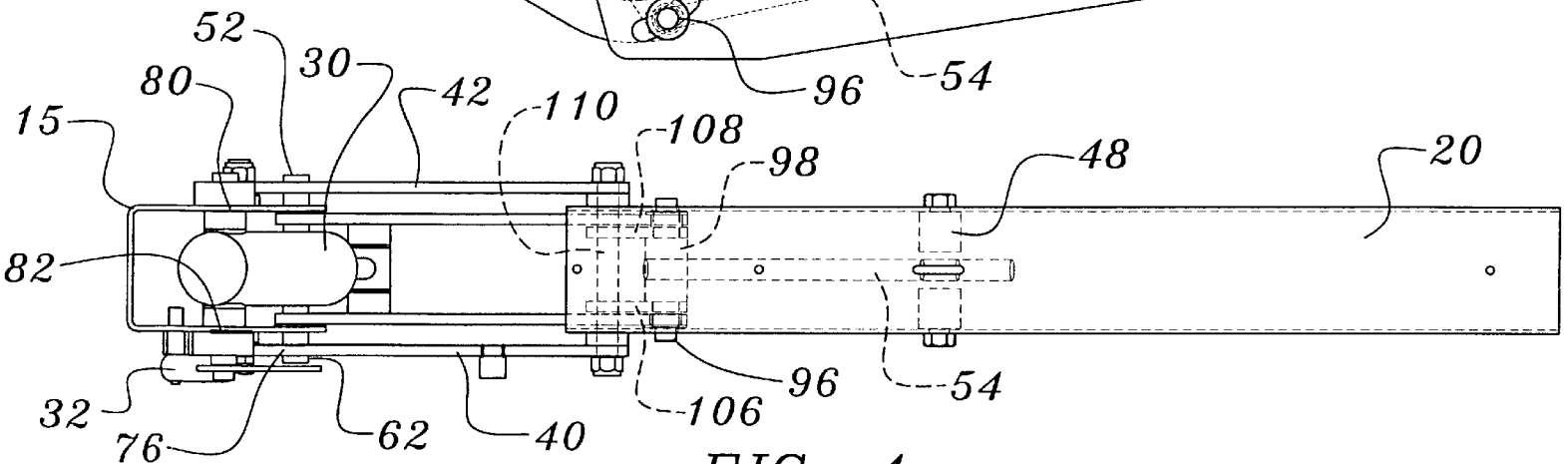
FIG. 4 is a top plan view of the boat lift apparatus of FIG. 3.
Figure 5:
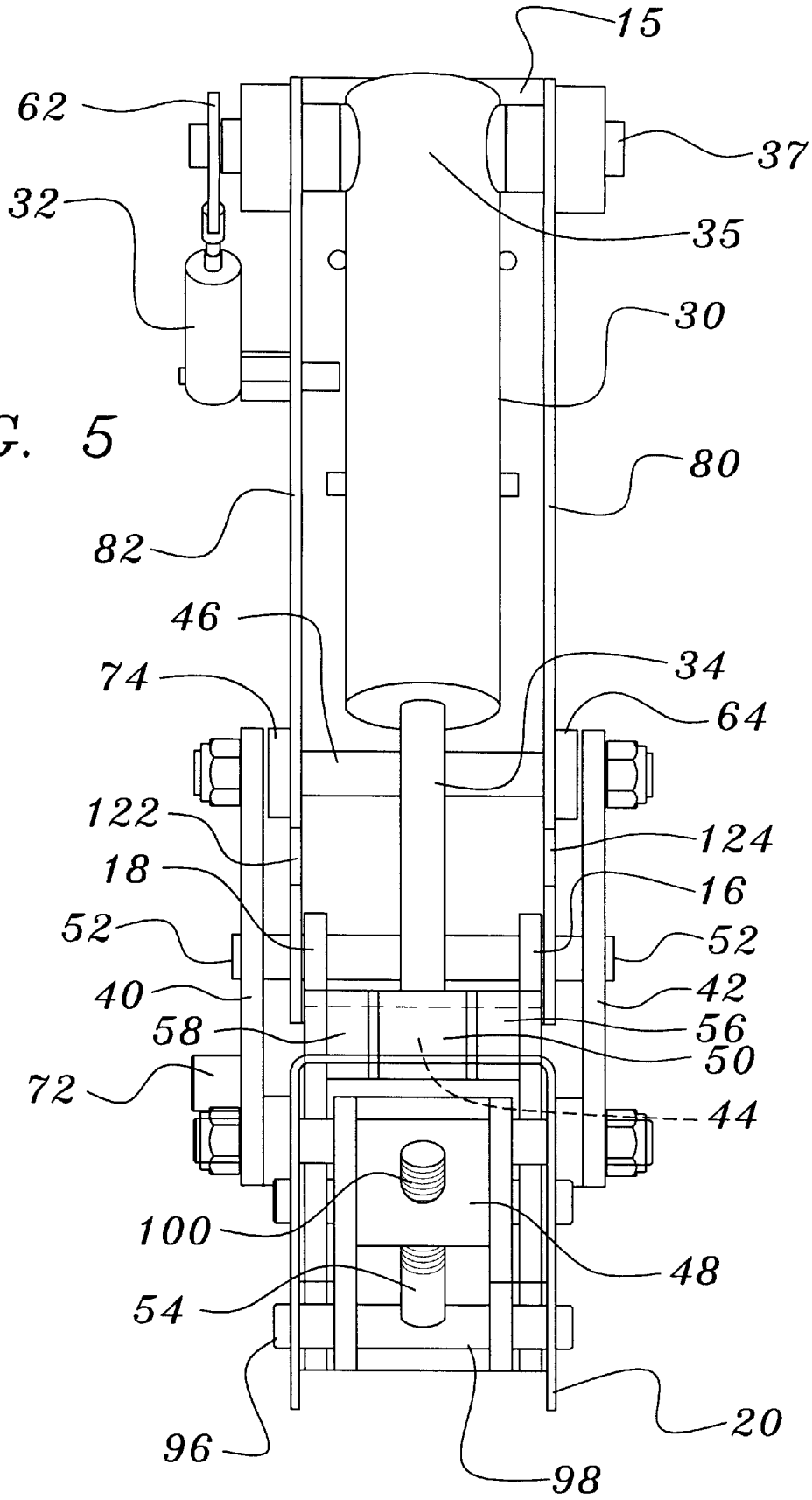
FIG. 5 is an elevational front view of the boat lift apparatus of FIG. 3.
Figure 6:
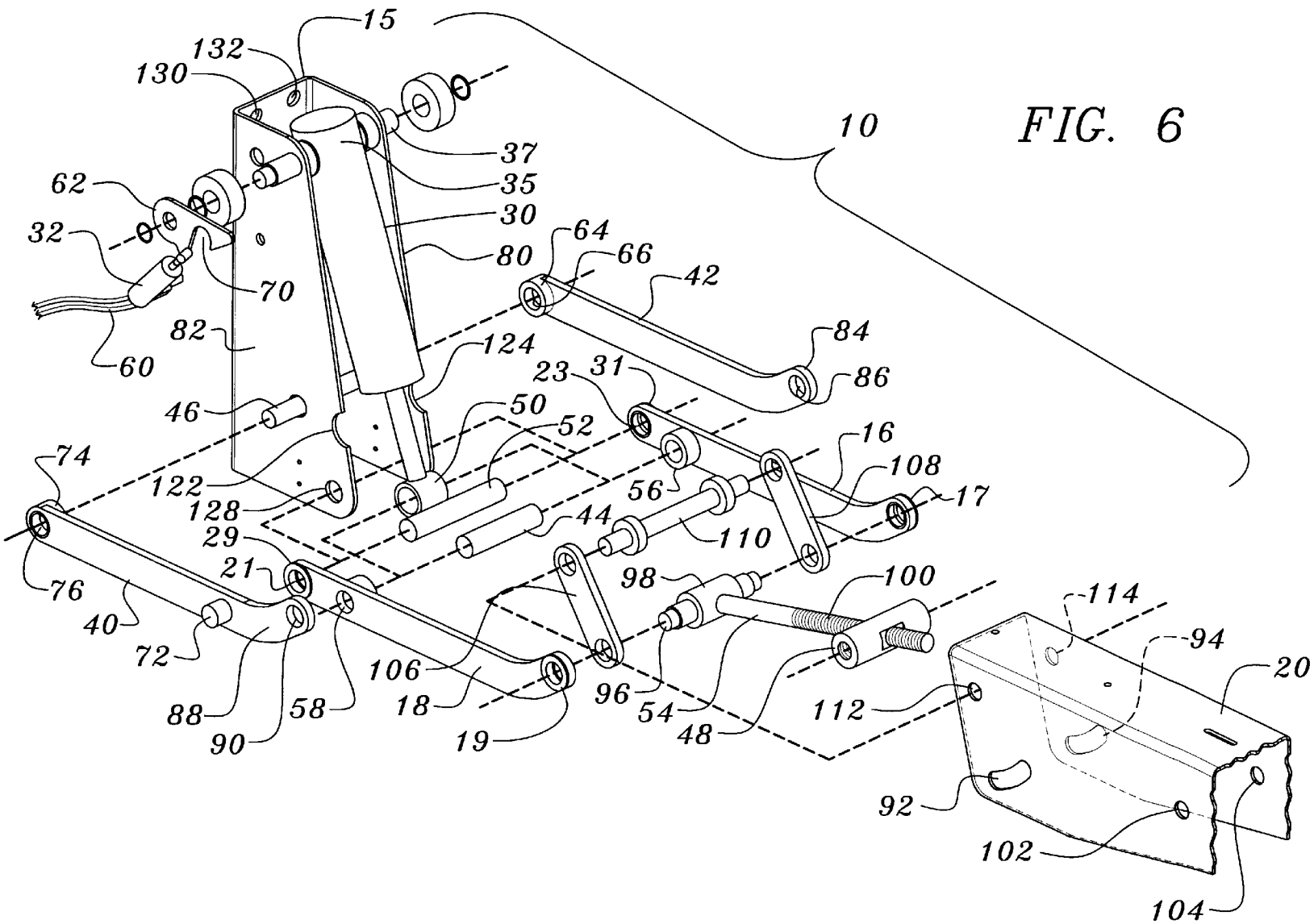
FIG. 6 is an exploded view of the hydraulic boat lift apparatus.

Throughout the following detailed description., the same reference numerals refer to the same element in all figures. Turning first to FIGS. 1 and 2, the hydraulic boat lift apparatus 10 is mounted to a boat 14 at its transom 12 or 12A by a transom bracket 15. In the boat 14 transom 12 is angled downward towards the waterline 28 and transom 12A is angled upward. In either case, transom bracket 15 is mounted directly to transom 12 or 12A.

The hydraulic boat lift apparatus 10 has a pair of parallel inboard lift arms 16 and 18, each having a distal end 17 and 19 respectively mounted within a platform bracket 20. The platform bracket 20 supports a platform 22 and an auxiliary watercraft cradle 24 on which an auxiliary watercraft 26 is mounted.

Turning to FIGS. 3–6, the inboard lift arm 16 has a bore 23 at a proximal end 31 and inboard lift arm 18 has a bore 21 at proximal end 29. A first transverse pin 52 passes through bores 21 and 23 and extends outwardly from both bores 21 and 23.

A power cylinder 30 has a unitary construction with a transverse bore at the blind end 35 through which a support pin 37 passes. The power cylinder rod 34 has a transverse coupler 50 distal from the power cylinder 30. A second transverse pin 44 passes through coupler 50 and connects to transverse bores 56 and 58 positioned proximal to bores 23 and 21 respectively on arms 16 and 18 respectively.

Figure 7:
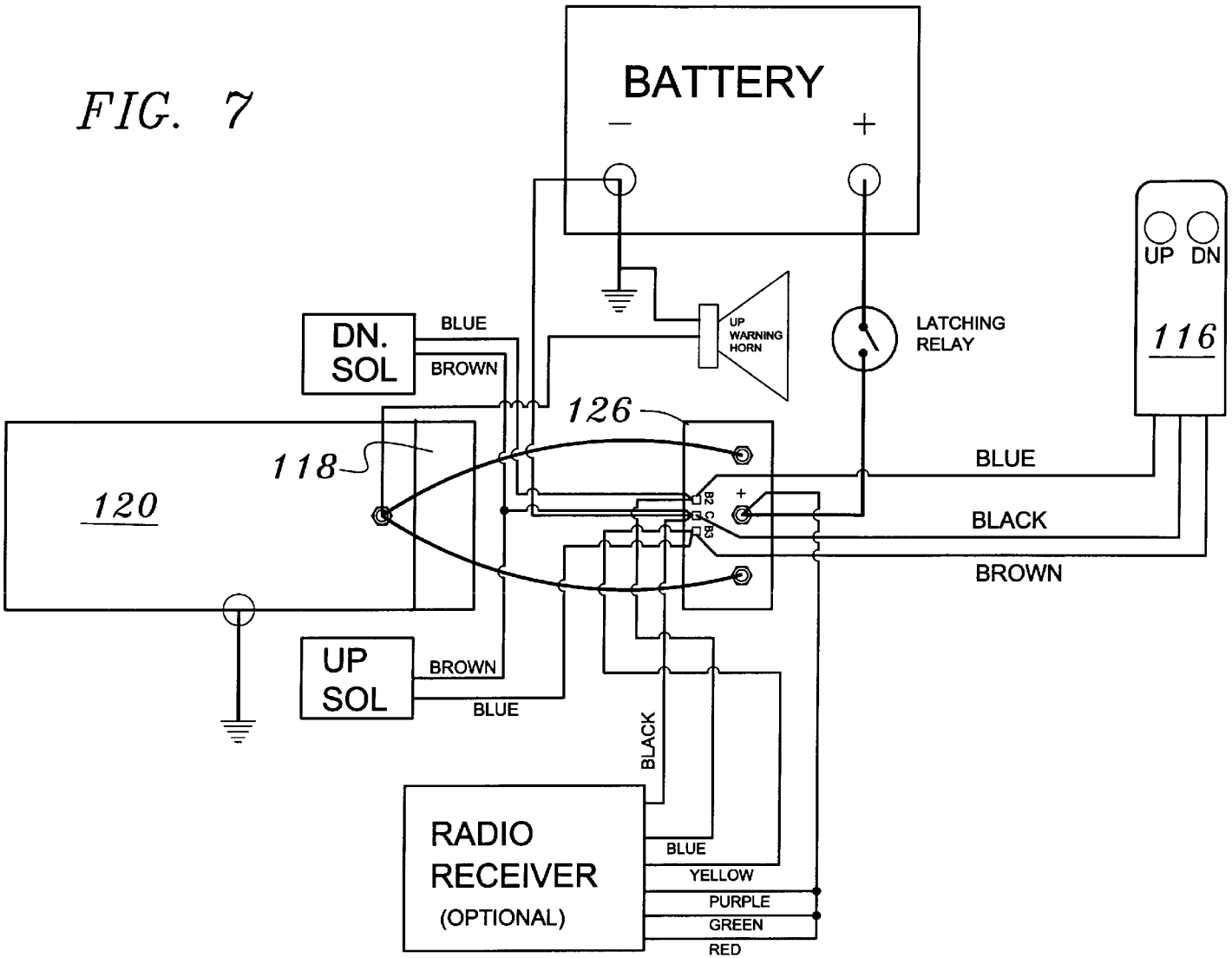
FIG. 7 is a schematic of the electrical system operating the hydraulic boat lift apparatus.
Figure 8:
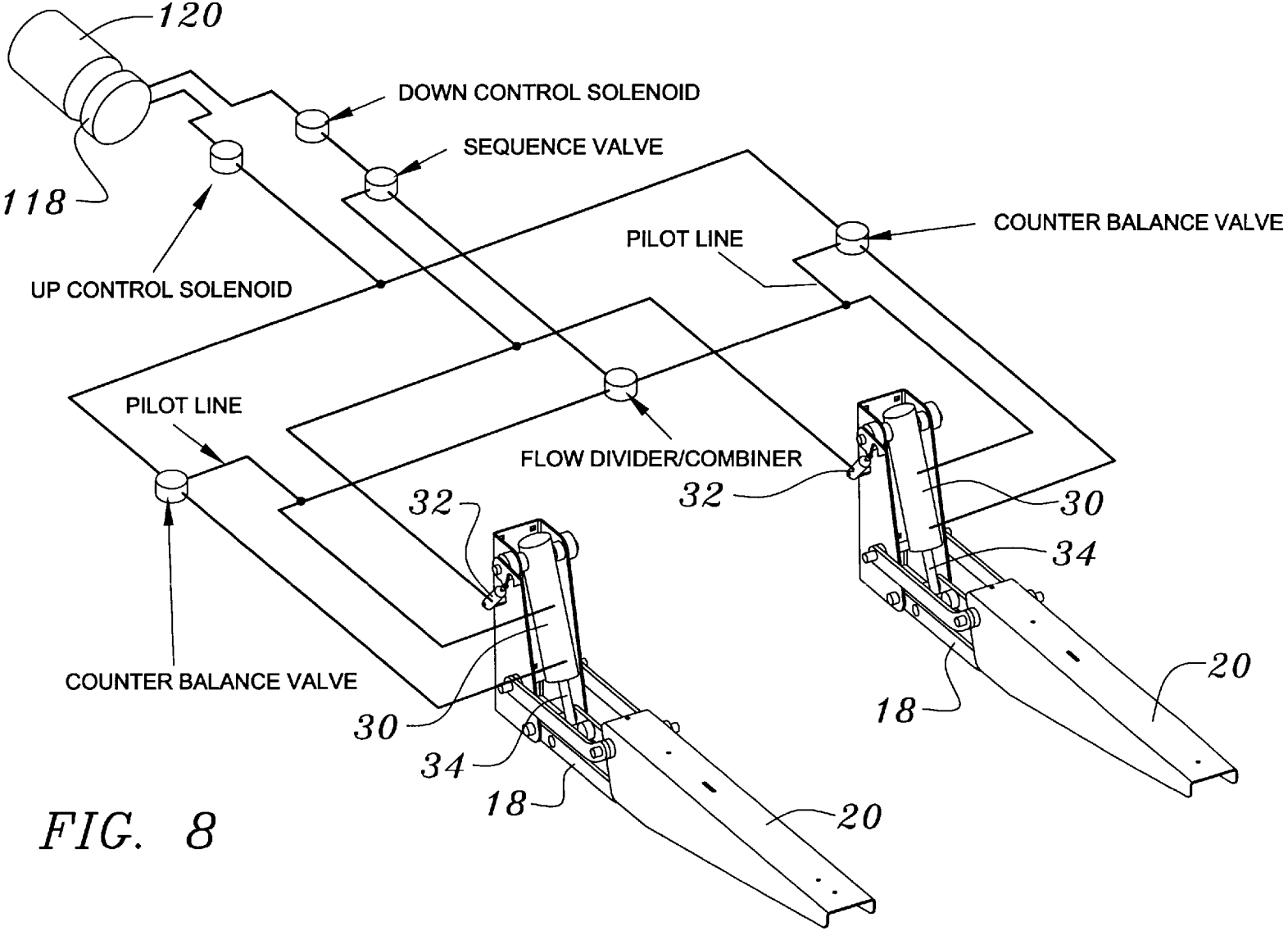
FIG. 8 is a schematic of the hydraulic system operating two hydraulic lifts for the boat lift apparatus.

A hydraulic fluid conduit 60 leads to a lock cylinder 32 attached to a plate 62 having a locking groove 70. In the locked position groove 70 engages outward transverse projection 72 on a port side outboard lift arm 40. Actuation of the system 10 as seen in FIGS. 7 and 8 causes plate 62 to pivot and release transverse projection 72.

Another outboard lift arm 42 parallel to lift arm 40, has a back end 64 containing a transverse bore 66 corresponding to back end 74 containing a transverse bore 76 on lift arm 40. Bores 66 and 76 have a pin 46 passing therethrough as well as through side elements 80 and 82 of transom bracket 15. A front end 84 of lift arm 42 has a bore 86 connecting to front end 88 through bore 90 of arm 40 by third pin 110. Lift arms 42 and 40 respectively engage the ends of pin 52 on a downward movement so that the ends of pin 52 act as a positive stop. In this way, the outboard arms 42 and 40 cannot fold back over center when additional pressure is caused by wave action on the platform 22.

Platform bracket 20 has a slot 92 and 94 on each side through which ends of fourth pin 96 pass. Pin 96 passes through a bore on the proximal end 98 of an adjuster rod 54. A distal half 100 of the adjuster rod 54 is threaded and a pin 48 moves along the threads to adjust the angle of repose of the platform bracket 20. The pin 48 is attached to platform bracket 20 at transverse bores 102 and 104. Links 106 and 108 connect pin 96 to pin 110 which engages bores 90 and

86 respectively on outboard lift arms 40 and 42. Pin 96 also engages links 108 and 106 to bores 17 and 19 respectively on inboard lift arms 16 and 18. Third pin 110 also passes through transverse bore 112 and 114 on platform bracket 20.

Operation of the hydraulic lift system 10 shown in FIG. 7 is initiated by a hand held control 116. Pushing one of the up or down buttons activates the motor 118 which causes the hydraulic pump 120 to cause the lock cylinder 32 to unlock pin 72 and allow movement of the arms by power cylinder 30.

Grooves 122 and 124 on side elements 82 and 80 respectively of the transom bracket engage the ends of second pin 44 to limit the travel of the boat lift apparatus 10 in an upward configuration.

Figure 9:
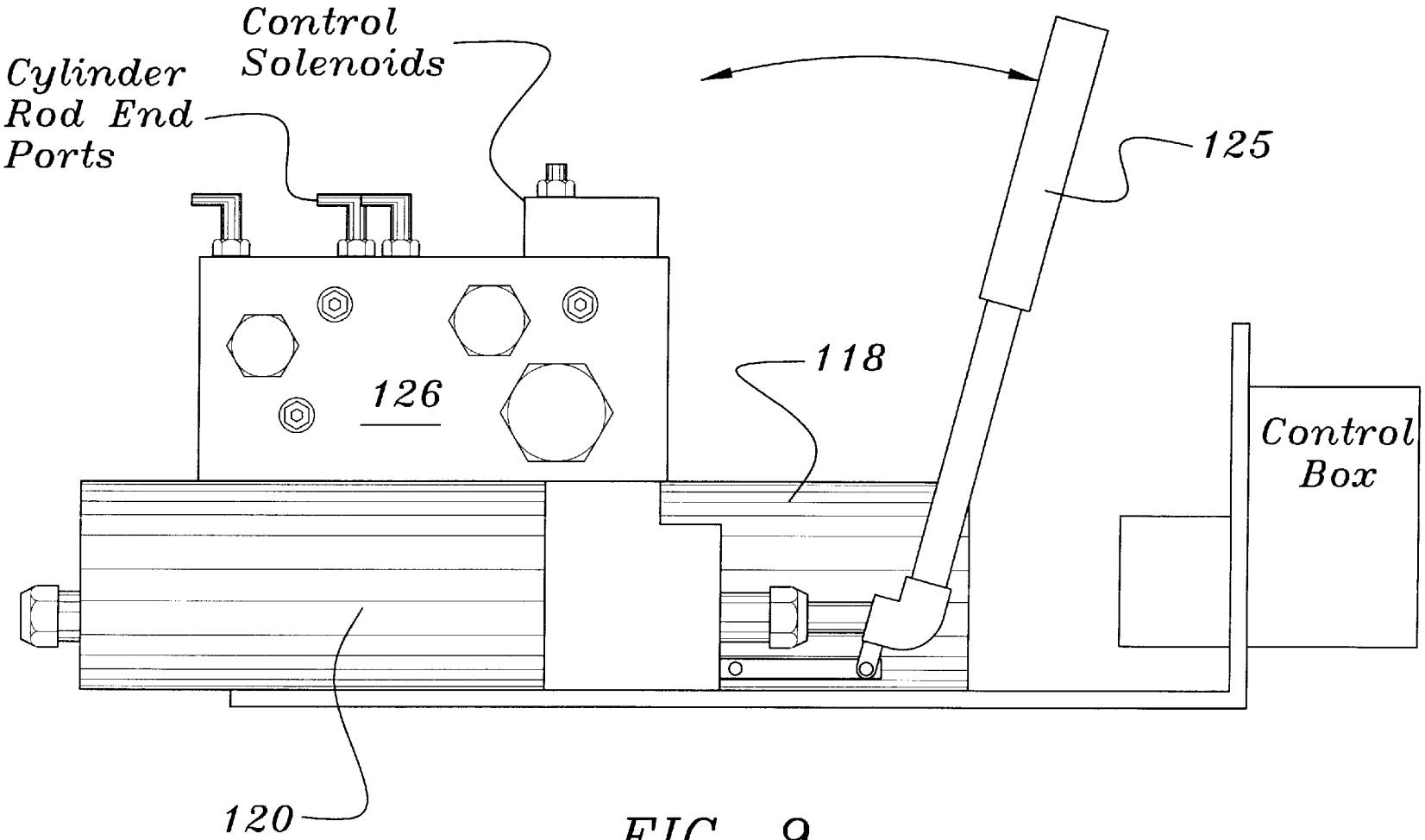
FIG. 9 is a side elevation view of the manual system for operating the lift apparatus.

As shown in FIG. 9, handle 125 is moved in and out to operate pump 120 and cause a flow of oil in the block manifold 126 to operate the hydraulic lift system manually.

Figure 10:
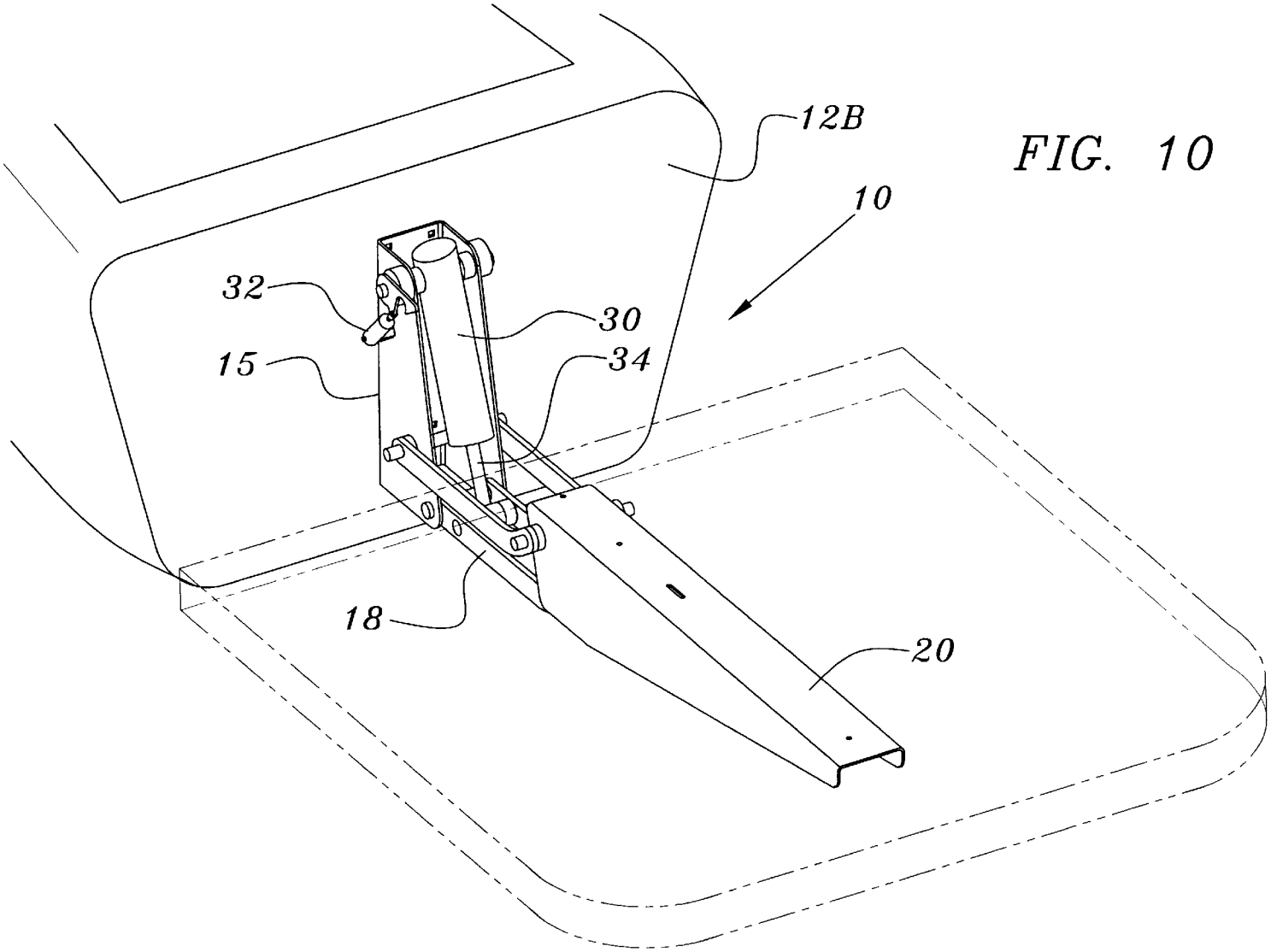
FIG. 10 is a prospective of a single hydraulic lift for a light duty platform attached to a small boat transom.

While it requires a pair of hydraulic boat lift apparatus to lift platform 22, a single hydraulic boat lift apparatus as shown in FIG. 10 is sufficient to lift a platform operated by the lift apparatus attached to transom 12B.

Various changes, modifications and alterations can be contemplated by those skilled in the art without departing from the intended spirit and scope thereof. As such, it is intended that the present invention only be limited by the terms of the appended claims.

Having thus described the invention, what is claimed and desired to be secured by Letters Patent is:

1. An improved hydraulic watercraft lift apparatus mounted to the transom of a boat, the apparatus having a transom bracket with parallel side plates enclosing a power cylinder hydraulically moving a pair of parallel inboard and a pair of parallel outboard lift arms, connecting to a platform bracket supporting a platform, the improvement wherein:

(a) a groove on a lock plate operated by a lock cylinder adjacent the transom bracket engages a transverse projection on an outboard lift arm to lock the lift apparatus in an upright out of the water position;

(b) a first transverse pin passing through proximal end bores on the parallel inboard lift arms and extending outwardly beyond the inboard lift arms to stop downward movement of the outboard parallel lift arms;

(c) a second transverse pin passing through a coupler attached at the end of a downwardly descending rod operated by the power cylinder, and the second transverse pin further passing through intermediate bores on the parallel inboard lift arms; and (d) grooves on a side plate on each side of the transom bracket engaging the first transverse pin to limit travel of the lift apparatus to prevent over center travel of the lift arms.

2. The improved hydraulic watercraft lift apparatus according to claim 1 wherein the lock cylinder is an integral piston and plate component.

3. The improved hydraulic watercraft lift apparatus according to claim 1 wherein a blind end of the power cylinder is continuous with a body of the power cylinder and contains a transverse bore for receipt of a transverse support pin.

4. The improved hydraulic watercraft lift apparatus according to claim 1 wherein a proximal end bore on each outboard lift arm is connected by a transverse pin passing through the side plates of the transom bracket.

5. An hydraulic watercraft lift apparatus mounted to the transom of a boat by a transom bracket having side plates enclosing a power cylinder, the apparatus comprising:

a platform bracket supporting a platform for receipt of a small watercraft;

a pair of parallel inboard and a pair of parallel outboard lift arms, each having a distal end mounted within an interior portion of the platform bracket and the outboard lift arms having a proximal end engaged to a transverse pin passing through bores on the side plates of the transom bracket;

each inboard lift arm having a proximal end engaged to a first transverse pin;

a distal end of each outboard lift arm engaged to a second transverse pin;

a distal end of each inboard lift arm engaged to a fourth transverse pin;

the power cylinder mounted substantially vertical within the transom bracket, a power cylinder rod descending downwardly with a transverse coupler at a lower end adapted to receive the second transverse pin;

the distal end of the outboard and inboard lift arm connected to the platform bracket;

the first transverse pin passing outward of the inboard lift arms to act as a stop on downward movement of the outboard lift arms;

a lock cylinder mounted to an exterior surface of the transom bracket operating a plate containing a groove for capturing an external projection on a port outboard lift arm; and an electrical system for actuating the hydraulic power cylinder.

6. The apparatus according to claim 5 further having a manual override system containing a hand pump to operate the lift apparatus without the need for electrical power.

* * * * *